US005267495A

United States Patent [19]

Magliocchetti et al.

[11] Patent Number: 5,267,495

[45] Date of Patent: Dec. 7, 1993

[54] IMPLEMENT FOR REMOVING A CAP FROM A CONTAINER

[75] Inventors: Carmine Magliocchetti, Latina; Giocondo Perugini, Rome, both of Italy

[73] Assignee: Sigma-Tau Industrie Farmaceutiche Riunite S.p.A., Rome, Italy

[21] Appl. No.: 982,043

[22] Filed: Nov. 25, 1992

Related U.S. Application Data

[63] Continuation of Ser. No. 836,909, Feb. 19, 1992, abandoned.

[30] Foreign Application Priority Data

Mar. 11, 1991 [IT] Italy ..... 91 U000 188

[51] Int. Cl.[5] ..... B67B 7/14

[52] U.S. Cl. ..... 81/3.56

[58] Field of Search ..... 81/3.55, 3.56, 3.57, 81/3.07, 3.08, 3.27, 3.29, 3.47, 3.48

[56] References Cited

U.S. PATENT DOCUMENTS 1,711,225 4/1929 Crowell ..... 81/3.56

*Primary Examiner*—D. S. Meislin

*Attorney, Agent, or Firm*—Oblon, Spivak, McClelland, Maier & Neustadt

[57] ABSTRACT

An implement suitable for removing the metal cap from a container of plastics material of the drinking-bottles for small laboratory animals is disclosed, which comprises a handle and a ring fastened thereto suitably shaped for being snugly fitted around the cap. The implement further comprising means for engaging the bottom edge of the cap in order to lift the cap following a leverage action exerted by the user on the handle.

3 Claims, 2 Drawing Sheets

IMPLEMENT FOR REMOVING A CAP FROM A CONTAINER

This application is a continuation of application Ser. No. 07/836,909, filed on Feb. 19, 1992, now abandoned.

BACKGROUND OF THE INVENTION

1. Field of the Invention

The present invention relates to a hand-operated implement, which is so structured as to enable a metal cap to be easily removed from a container of plastics material which compose the drinking-bottles used in animal breeding departments for small laboratory animals, such as mice, Guinea pigs, or other animals.

2. Discussion of the Related Art

Heretofore, the separation of the two parts which constitute the drinking-bottle, in order to allow the latter to be filled, is manually carried out by the animal breeding departement operators.

Although this operation may seem an extremely simple one, in practice the separation is often cumbersome, or complicated, in that both parts are firmly sticking to each other. The sticking is the result of several contributing factors, such as an excessive stress previously applied by the operator during the last assembly of the two components of the drinking-bottle, or a misalignment thereof, the presence of solid residues deposited on the container neck deriving from the evaporation of the liquid contents of the container, wear of the container neck, and other factors.

Due to these reasons, in order to remove the metal cap from the container of the drinking-bottle, the operator must resort to improper means, such as pliers and pincers, or he must exert leverage on the tube of the metal cap, which may result in a deformation of the metal cap, and/or in a breakage of the container, the integrity of the drinking-bottle being hence compromised, its functionality being endangered, and the replacement thereof with a new drinking-bottle becoming necessary.

SUMMARY OF THE INVENTION

In order to overcome, the foregoing drawbacks, the present invention provides for a hand-operated tool, which is structured so as to secure that removal of the metal cap from the container made of plastics material is carried out effectively and simply.

The implement leaves the constituting parts of the drinking-bottle in a perfectly unspoiled condition, thus securing a long useful life thereof and furthermore preventing any direct contact between the operator's hands and the metal cap, thus improving the hygienic conditions.

BRIEF DESCRIPTION OF THE DRAWINGS

The particular configuration of the hand-operated implement according to the present invention is now illustrated in the following detailed description with reference to the attached drawings, wherein.

DESCRIPTION OF THE PREFERRED EMBODIMENT

Figure 1:
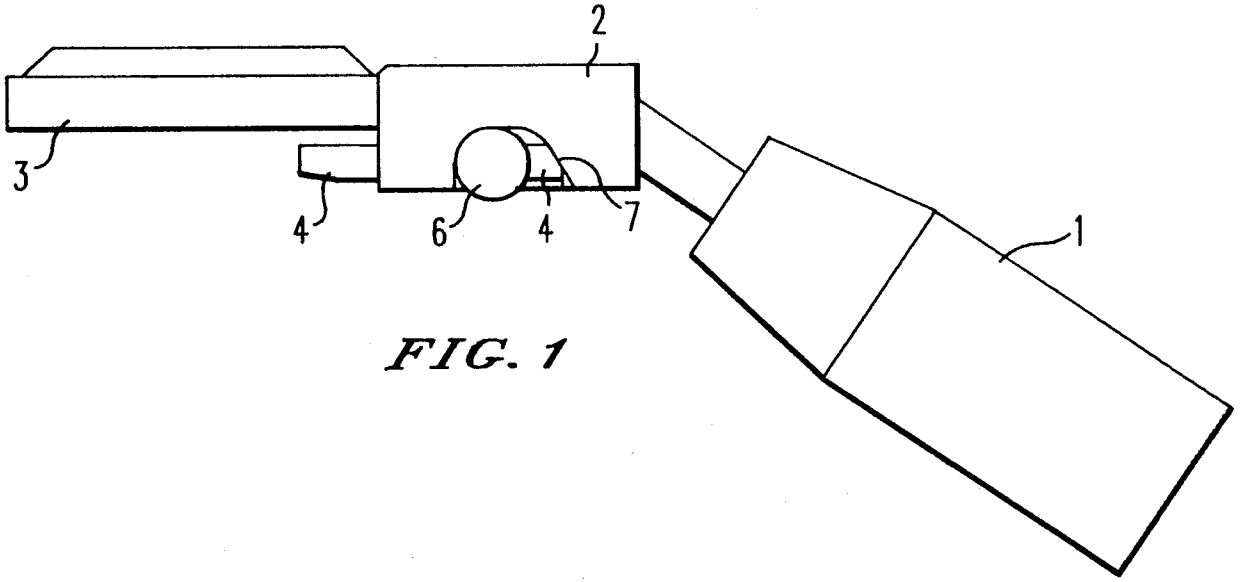
FIGS. 1 and 2 is a side view and a top plan view, respectively, of the implement according to the invention.
Figure 2:
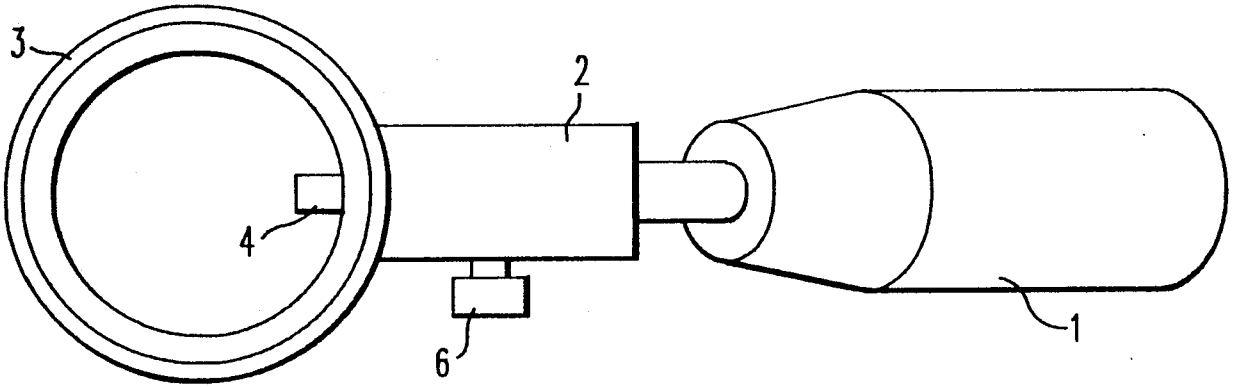

As one may observe from FIGS. 1 and 2, the hand-operated implement according to the present invention substantially comprises a handle 1 integral with a body 2 onto which a ring 3 is fastened, which has an inner diameter equal to, or slightly exceeding, the outer diameter of the cylindrical wall of the cap 11 of the drinking-bottle.

In its bottom portion, the body 2 is provided with an elongated hollow 2*a* extending along the handle 1/ring 3 direction. The hollow 2*a* opens towards the ring 3, and at its opposite end, is closed by a wall 2*b* and on its side wall is opened by a passing through-slot 7.

Inside the hollow 2*a* there are housed a piston 4 bevelled in 4*a*, sliding inside said hollow, and a spring 5 positioned between the piston 4 and the wall 2*b*. The piston 4 is provided with a button-shaped protrusion 6, integral with the same piston. When the spring 5 expands, it biases the piston 4 to exit the hollow 2*a*, until (see FIG. 1), the protrusion 6 engages the wall of the hollow 7, which acts as a shoulder for the protrusion 6.

As it can be clearly seen in FIG. 2, the length of the piston 4 is such that, when said piston is in its rest position, its protruding end considerably extends beyond the inner edge of the ring 3.

Figure 4:
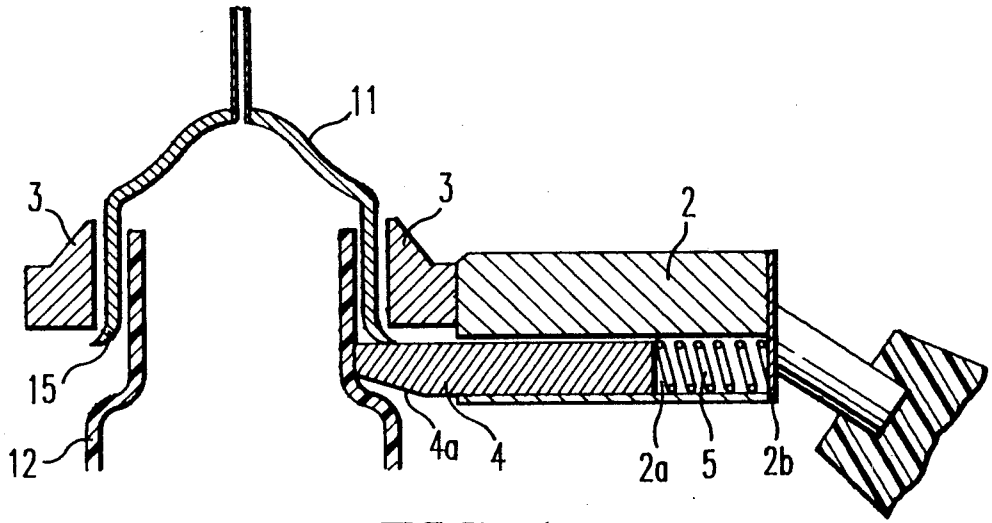
FIG. 4 is a side sectional view of the implement applied onto on the cap of the drinking-bottle before the cap is removed from the drinking-bottle container.
Figure 3:
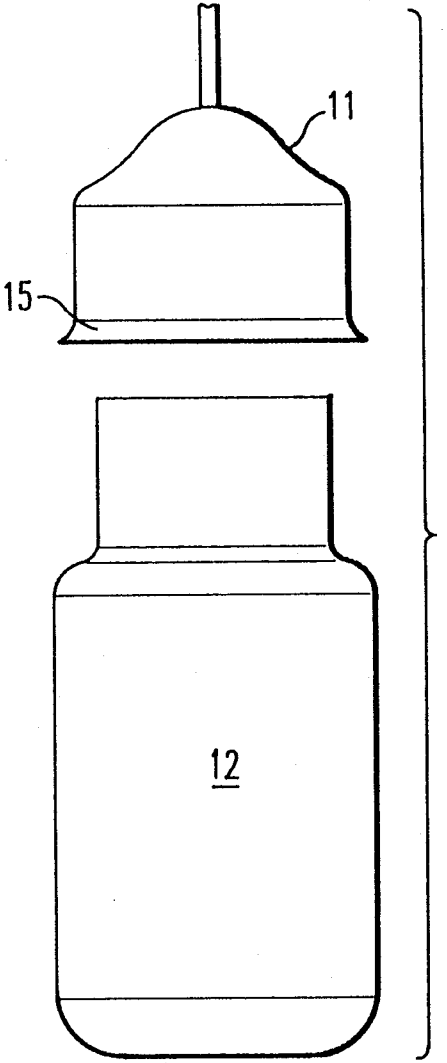
FIG. 3 is an exploded view of the drinking-bottle.

Referring to FIG. 4, the operator, after applying the ring 3 of the implement onto the cap of the drinking-bottle causes said ring 3 to slide along the cap wall until, overcoming the pressure of the spring 5, he causes the bevelled end 4*a* of the piston 4 to slide beyond the edge 15 of the cap 11.

When the operator has caused the piston to slide beyond the edge 15, the spring 5 keeps said piston 4 biased against the body 12 of the drinking-bottle, while simultaneously engaging the edge 15 of the cap. Then in order to remove the cap, the operator has just to exert leverage on the handle 1. The piston 4, acting against the lower edge of the cap, causes the cap to be easily disengaged from the body of the drinking-bottle.

Once that both parts of drinking-bottle are separated from each other, the operator, acting on the button-shaped protrusion 6 in such a way as to win the resistance of the spring 5, causes the piston 4 to retract, thus disengaging the cap 11 from the ring 3.

It should be noted that, although the laboratory drinking-bottles available on the market may have, of course, very different capacities from one another, their caps retain constant dimensions (in particular, their diameter is constant). Therefore, the hand-operated tool according to the present invention can be used with all the drinking-bottles available on the market, irrespective of their capacity.

The size of, and the materials used for the implement, according to the present invention, may vary according to any usage requirements.

We claim:

1. An implement for removing a metal cap of a laboratory drinking-bottle, said implement comprising:

a body with a hollow;

a ring for being applied around said cap, integral with said body, at the end of said body at which said hollow opens;

a handle integral with said body, at the opposite end relatively to the ring;

a piston slidable inside said hollow from a position in which said piston is contained inside said hollow, to a position in which said piston protrudes from said hollow for engaging a bottom edge of said cap; and means for urging said piston outwards.

2. The implement according to claim 1, in which the end of said piston is bevelled, in order to facilitate the insertion thereof under the edge of said cap.

3. An implement for removing a metal cap from a body of a laboratory drinking bottle, said implement comprising:

a ring which can be applied around said cap, said cap being provided on said body of said drinking bottle;

a body attached to said ring;

a handle attached to said body of said ring; and means for engaging a bottom edge of said cap for lifting said cap following a leverage action exerted on said handle;

wherein said means for engaging said bottom edge of said cap comprises:

a piston movably attached to said body of said ring; and elastic means for urging said piston towards a center of said ring, said piston having a protrusion integral with said piston for permitting a retraction of said piston against the urging of said elastic means.

* * * * *

UNITED STATES PATENT AND TRADEMARK OFFICE

CERTIFICATE OF CORRECTION

PATENT NO. : 5,267,495

DATED : December 7, 1993

INVENTOR(S) : Carmine Magliocchetti et al.

It is certified that error appears in the above-indentified patent and that said Letters Patent is hereby corrected as shown below:

On the title page, Item [30],

The Foreign Application number, should read: --MI91 U 000188--

Signed and Sealed this

Third Day of May, 1994

Bruce Lehman

*Attest:*

BRUCE LEHMAN

*Attesting Officer*

*Commissioner of Patents and Trademarks*